US005139447A

United States Patent [19]

Yoneda et al.

[11] Patent Number: 5,139,447

[45] Date of Patent: Aug. 18, 1992

[54] CONNECTOR WITH A TERMINAL LOCKING MEMBER

[75] Inventors: Takahiro Yoneda, Kanagawa; Masanori Tsuji; Motohisa Kashiyama, both of Shizuoka, all of Japan

[73] Assignee: Yazaki Corporation, Tokyo, Japan

[21] Appl. No.: 797,884

[22] Filed: Nov. 26, 1991

[30] Foreign Application Priority Data

Nov. 30, 1990 [JP] Japan ..... 2-126553[U]

[51] Int. Cl.[5] ..... H01R 13/436

[52] U.S. Cl. ..... 439/752; 439/595

[58] Field of Search ..... 439/595, 752

[56] References Cited

U.S. PATENT DOCUMENTS

| | | | |
|---|---|---|---|
| 4,891,021 | 1/1990 | Hayes et al. | 439/752 |
| 5,037,336 | 8/1991 | Betsui et al. | 439/752 |
| 5,066,253 | 11/1991 | Kameyama | 439/595 |
| 5,071,373 | 12/1991 | Nagasaka et al. | 439/595 |

FOREIGN PATENT DOCUMENTS 63-58470 4/1988 Japan .

*Primary Examiner*—Gary F. Paumen

*Attorney, Agent, or Firm*—Armstrong, Nikaido, Marmelstein, Kubovcik & Murray

[57] ABSTRACT

The connector consists of a connector housing with a plurality of terminal accommodating chambers and a terminal locking member mounted to the rear portion of the connector housing. The terminal locking member is fitted to the connector housing in one of two engagement states—a preliminarily engaged state and a fully engaged state. The terminal locking member has resilient support pieces for fixing the terminal lugs in the terminal accommodating chambers. When the terminal locking member is moved backwardly from the preliminarily engaged state, the resilient support pieces ride on triangular engagement projections formed on the connector housing, moving outwardly out of the insertion path of the terminal lugs. This allows the terminal lug in question to be pulled out without disengaging the terminal locking member from the connector housing.

6 Claims, 6 Drawing Sheets

CONNECTOR WITH A TERMINAL LOCKING MEMBER

BACKGROUND OF THE INVENTION

1. Field of the Invention

The present invention relates to an improvement in a connector with a double locking structure in which connection terminals installed in terminal accommodating chambers in a connector housing are securely locked by a terminal locking member that is fitted to the connector housing from the rear of the terminal accommodating chambers.

2. Description of the Prior Art

An example of conventional connector with such a terminal locking member is shown in FIGS. 6 to 8 (Japanese Utility Preliminary Publication No. Showa 63-58470).

In these drawings, reference symbol a represents a connector housing having a plurality of terminal accommodating chambers $a_1$ with a hood b attached over the circumference of the rear portion thereof. In the hood b a terminal locking member c is installed longitudinally movable.

The terminal locking member c has a plurality of resilient terminal locking pieces d, each of which is located inside the corresponding terminal accommodating chamber $a_1$ (FIG. 8). The terminal locking member c has resilient engagement arms e on each side that project forwardly from a gap f and which are formed at the front end with engagement claws $e_1$ that are to engage with end portions $b_1$ of the hood b to prevent the terminal locking member c from slipping off backwardly. In this way, the terminal locking member is attached to the connector housing a in a preliminarily or loosely engaged condition (FIG. 6 and FIG. 7A).

In the preliminarily engaged state, a terminal lug g is inserted into each terminal accommodating chamber $a_1$. At this time, an electrical contact portion $g_1$ of the terminal lug g comes into contact with the underside $d_2$ of an engagement bulged portion $d_1$ formed at the free end of the terminal locking piece d, causing the engagement bulged portion $d_1$ to escape upwardly into a groove $a_2$ formed in the terminal accommodating chamber $a_1$. Hence, the terminal lug g can be advanced forwardly (FIG. 8A) until it is locked by a resilient locking piece h provided in the terminal accommodating chamber a.

Next, in this condition as the terminal locking member c is pushed forwardly, the engagement bulged portion $d_1$ is guided along a tapered surface $a_3$ formed at the inner end of the groove $a_2$ and deflected inwardly. The engagement bulged portion $d_1$ then abuts against a stopper wall $a_4$ and at the same time engages with the back of the electrical contact portion $g_1$ of the terminal lug g. The terminal lug g is now doubly locked from coming off rearwardly. At this time, an engagement hole $e_2$ of the resilient engagement arm e fits over an engagement projection i formed on the sides of the connector housing a. Now, the terminal locking member c is in a fully engaged state (FIG. 7B, FIG. 8B).

In the above construction, when it becomes necessary to replace the terminal lug g as when the terminal lug is broken, the terminal locking member c is first removed from the connector housing a and then the resilient engagement piece h is disengaged from the terminal lug g by using a jig before pulling the terminal lug g out of the connector housing a.

In other words, to replace the terminal lug requires the terminal locking member to be completely separated from the connector housing. This not only is troublesome requiring a sequence of steps but also gives rise to a possibility of the disconnected terminal locking member being lost.

SUMMARY OF THE INVENTION

This invention has focused attention on the above problem and provides a construction in which the terminal lug can be pulled out without removing the terminal locking member from the connector housing.

To achieve the above objective, a connector with a terminal locking member of this invention comprises: a connector housing having a plurality of chambers accommodating terminal lugs therein; a terminal locking member movably mounted to the rear portion of the connector housing in two steps, said two steps including a preliminarily engaged state and a fully engaged state; resilient support pieces provided to the terminal locking member for fixing terminal lugs in the terminal accommodating chambers; and engagement projections provided to the connector housing for holding the terminal locking member in the preliminarily engaged state; whereby when the terminal locking member is moved backwardly from the preliminarily engaged state, the resilient support pieces ride on the engagement projections, thus moving out of the insertion paths of the terminal lugs.

DETAILED DESCRIPTION OF PREFERRED EMBODIMENT

Figure 1:
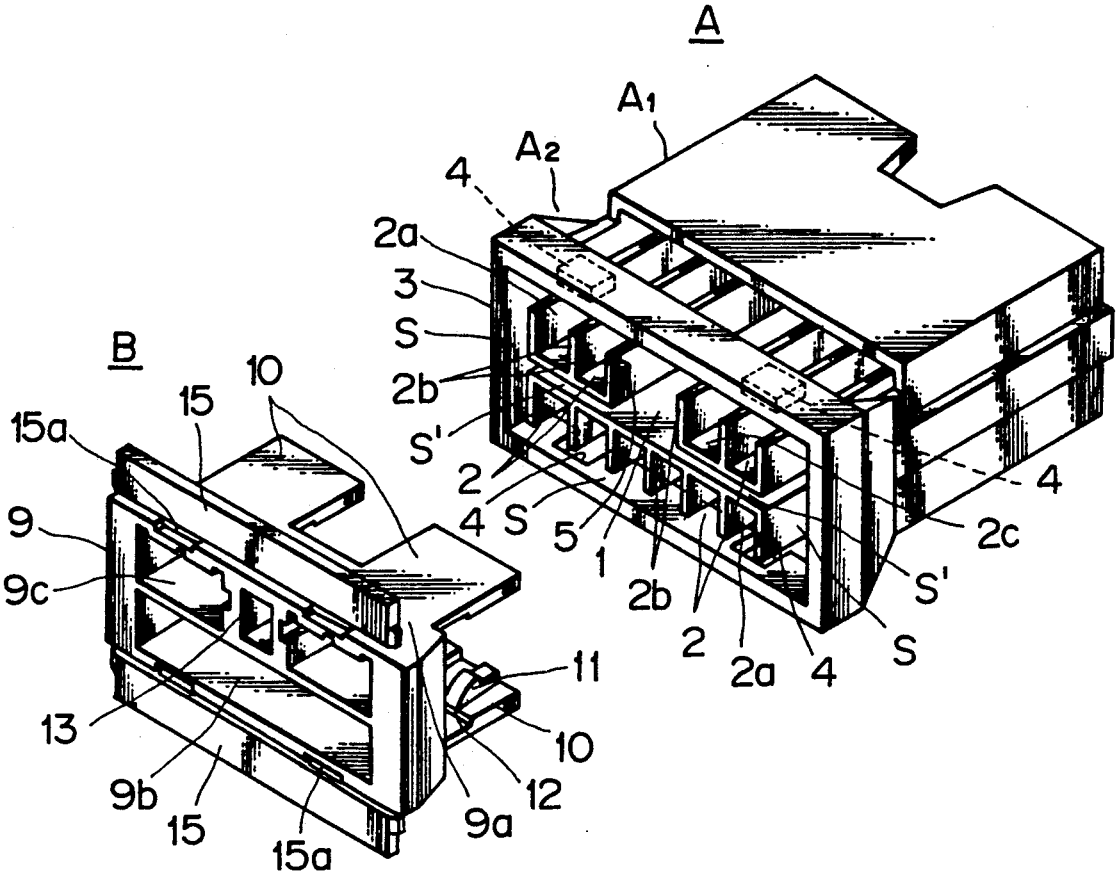
FIG. 1 is a perspective view, seen from the rear, of a connector housing and a terminal locking member as one embodiment of the invention shown separated from each other.
Figure 2:
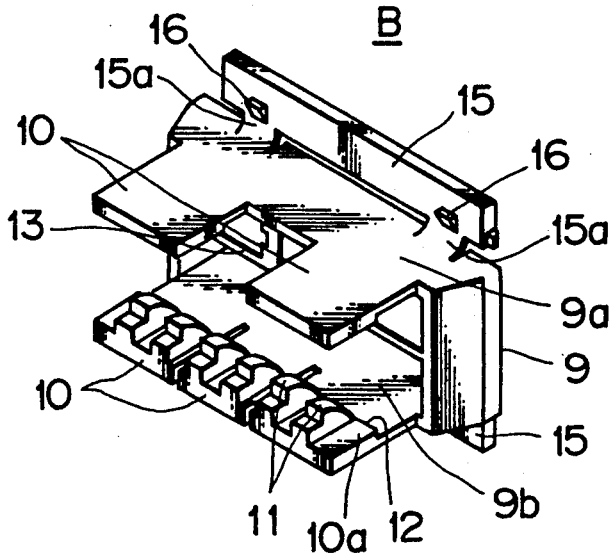
FIG. 2 is a perspective view of the terminal locking member.

In FIG. 1, reference symbol A represents a female connector housing and B a terminal locking member, both formed of synthetic resin.

The female connector housing A consists of a case portion $A_1$ formed at the front half and a terminal accommodating chamber block $A_2$ at the rear half. In the terminal accommodating chamber block $A_2$, there are four laterally arranged terminal accommodating chambers 2 at the upper tier with a space 1 interposed at the middle portion. At the lower tier there is a row of six laterally arranged terminal accommodating chambers 2. The terminal accommodating chambers 2 at the upper and lower tiers have upwardly or downwardly directed openings 2a respectively.

Around the outer circumference of the rear part of the terminal accommodating chamber block $A_2$ is provided a hood 3 with an annular space S interposed therebetween. The hood 3 has full-engagement ensuring portions 4 formed at the upper and lower part thereof which are to engage with the terminal locking member B for full-engagement (see FIG. 5). Separation walls 2b of the terminal accommodating chambers 2 that face the space 1 are formed with a pull-out prevention projection 5 for the terminal locking member B. There is a gap S' between the upper and lower tiers of the terminal accommodating chambers 2.

As shown in FIGS. 5A–F, bottom walls 2c of the terminal accommodating chambers 2 are each provided with a resilient engagement piece 6 that extends forwardly. The resilient engagement piece 6 works as a first locking member to prevent rearward slip-off of the terminal lug C. At the front of the terminal accommodating chambers 2 are provided stopper walls 7 for the terminal lugs C. The separation walls 2b of the terminal accommodating chambers 2 have a triangular engagement projection 8 on the end surface on the side of the opening 2a for making preliminary engagement with the terminal locking member B. The triangular engagement projection 8 has forwardly and rearwardly inclined surfaces.

The terminal locking member B has plate-like resilient support pieces 10 that extend forwardly from upper and lower plate portions 9a, 9b of a main frame portion 9. Each resilient support piece 10 corresponds to two terminal accommodating chambers 2. Hence, the upper plate portion 9a is provided with two resilient support pieces 10 with a gap therebetween, while the lower plate portion 9b is provided with three resilient support pieces 10 in a row.

On its inner surface, each resilient support piece 10 has two terminal locking projections 11 for two terminal accommodating chambers 2 and a step portion 12 for preliminary engagement.

The main frame portion 9 of the terminal locking member B also has a middle plate portion 9c. Between the upper plate portion 9a and the middle plate portion 9c is formed an engagement portion 13 that corresponds to the space 1. The engagement portion 13 is formed on each, side with an engagement piece 14 that engages with the pull-out prevention projection 5 (see FIGS. 3 and 4).

At the rear part of the upper and lower plate portions 9a, 9b of the main frame portion 9 are provided with engagement plates 15 that are urged to assume an upright attitude by hinges 15a. The engagement plate 15 is formed on its outer surface with projections 16 that engage with the full-engagement ensuring portions 4 to ensure full-engagement between the connector housing A and the terminal locking member B.

Figure 3:
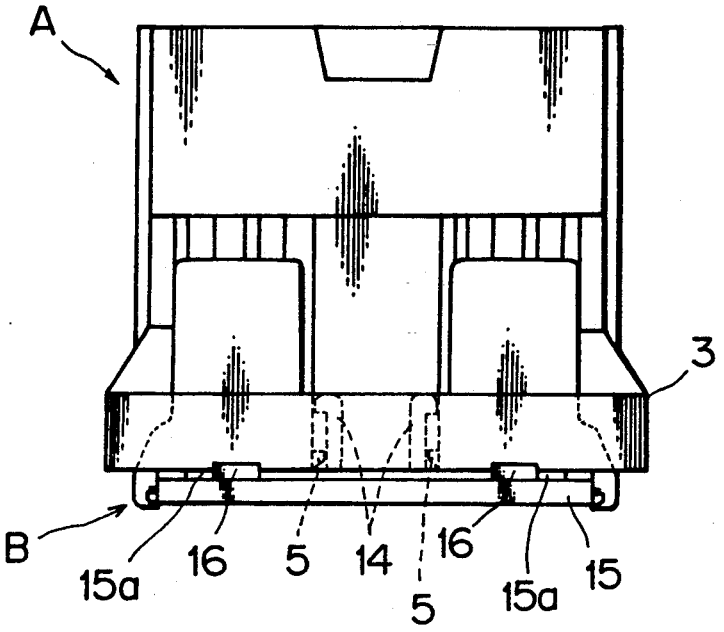
FIG. 3 is a plan view of the terminal locking member and the connector housing in a preliminarily engaged state.
Figure 4:
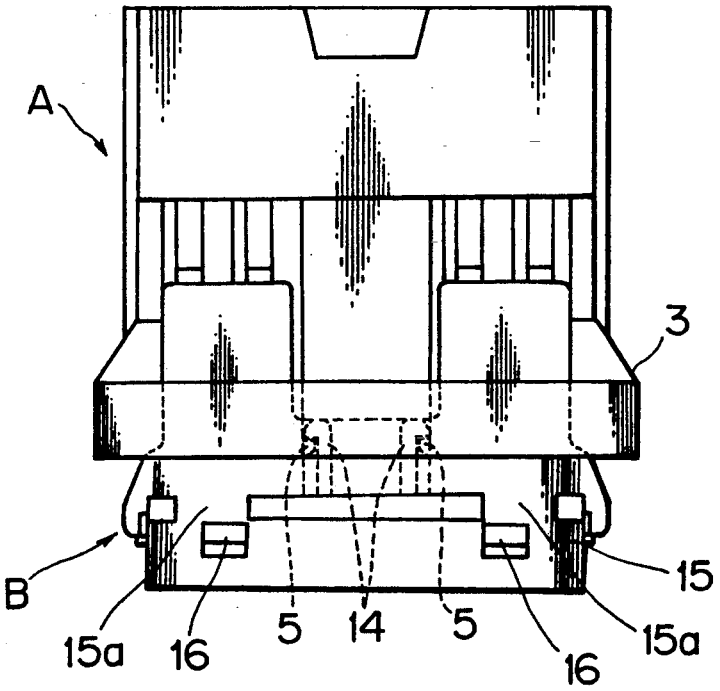
FIG. 4 is a plan view showing the terminal locking member disconnected from the connector housing.
Figure 5A:
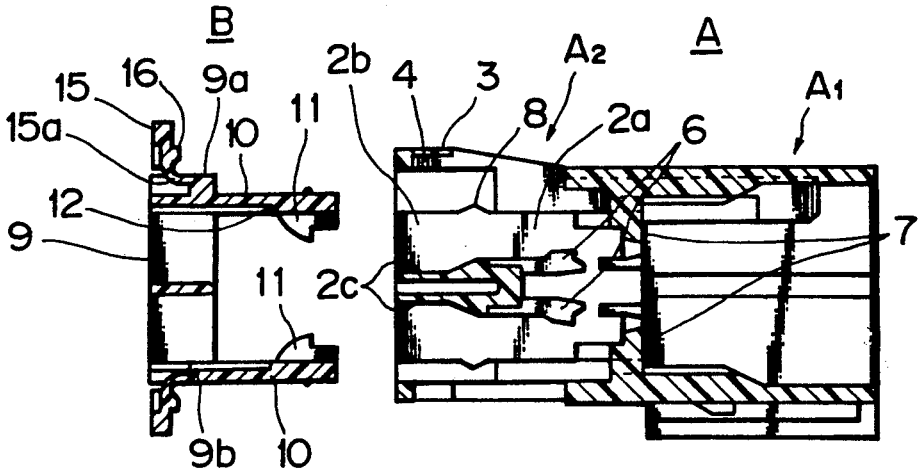
FIGS. 5A, 5B, 5C, 5D, 5E and 5F are cross sections showing relative positions of the terminal locking member with respect to the connector housing at each stage of the connecting process.
Figure 5B:
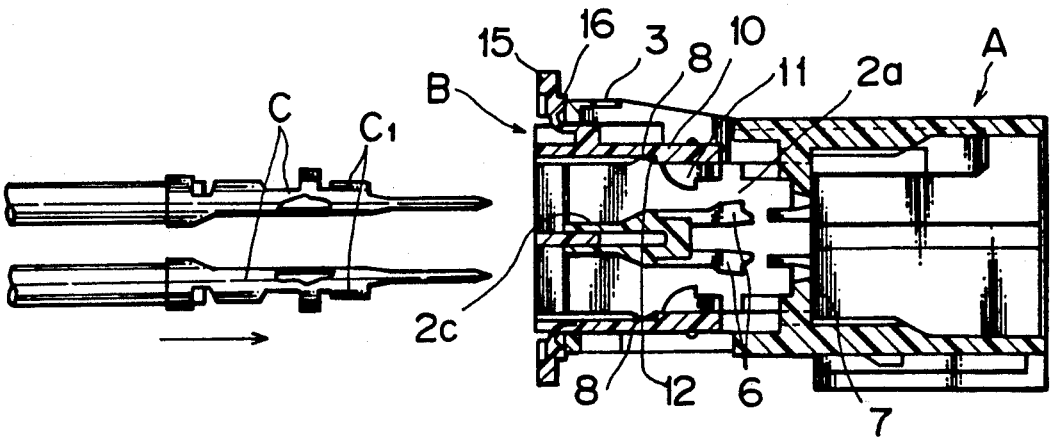

In the above construction, the terminal locking member B is coupled to the connector housing A first in the preliminarily engaged state. The preliminarily engaged state is obtained by the following procedure. The upper and lower resilient support pieces 10 and the upper and lower plate portions 9a, 9b of the terminal locking member B are inserted, from the condition of FIG. 5A, into the upper and lower parts of the annular space S, while at the same time inserting the middle plate portion 9c into the gap S'. When the resilient support pieces 10 ride over the triangular engagement projections 8 on the separation walls 2b, the preliminarily engaged step portions 12 engage with the triangular engagement projections 8. Now, the terminal locking member B is engaged with the connector housing A in the preliminarily engaged state (FIG. 5B and FIG. 3).

In the preliminarily engaged state, the upright engagement plate 15 abuts against the rear end of the hood 3 to prevent the terminal locking member B from undesirably moving further into the connector housing A, so that the pull-out prevention projections 5 are located away from the engagement pieces 14.

Figure 5C:
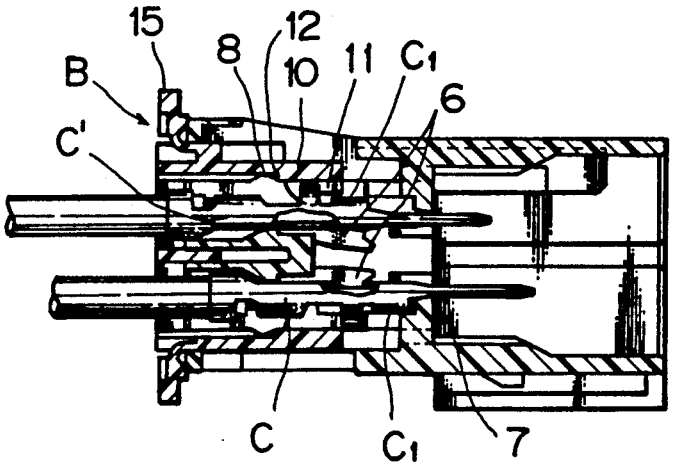

In the preliminarily engaged state, the terminal lugs C are inserted into the associated terminal accommodating chambers 2. At this time, an intermediate engagement portion $C_1$ of the terminal lug C engages with the terminal locking projection 11 but further advances, displacing the resilient support piece 10 outwardly through the opening 2a, until it rides over the terminal locking projection 11 and abuts against the stopper wall 7. Now, the terminal lug C is locked by the resilient engagement piece 6 from coming off rearwardly (FIG. 5C).

Figure 5D:
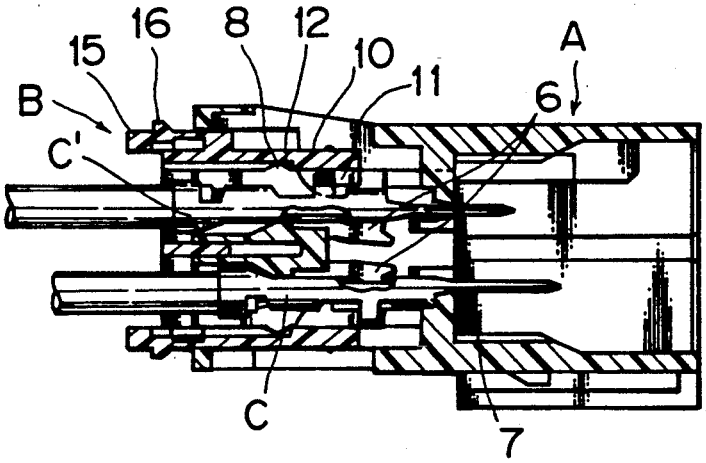
Figure 5E:
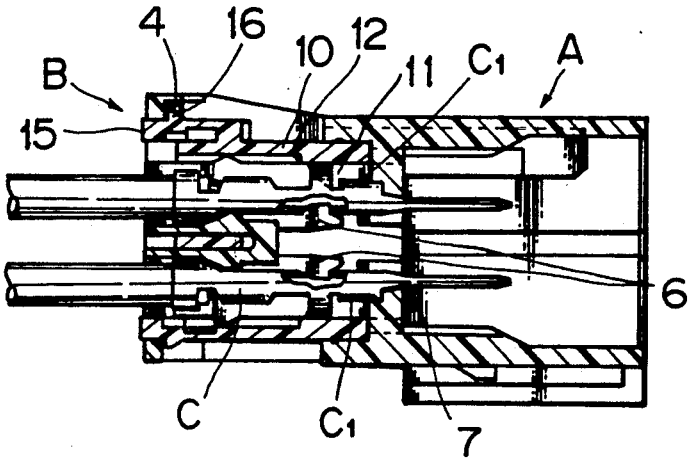

Next, the engagement plate 15 is set horizontal and the terminal locking member B is pushed into the connector housing A (FIG. 5D). At this time, the terminal locking projection 11 of the resilient support piece 10 engages with the intermediate engagement portion $C_1$ of an incompletely inserted terminal lug C', driving the terminal lug C' to the completely inserted position.

With the terminal locking member B completely inserted into the connector housing A, the full-engagement projection 16 of the engagement plate 15 engages with the full-engagement ensuring portion 4 of the hood 3, holding the terminal locking member B and the connector housing A in the fully engaged state. In this fully engaged state, the terminal locking projection 11 of the resilient support piece 10 is located immediately behind the intermediate engagement portion $C_1$. The terminal lug C is now prevented from coming off rearwardly by two means, the resilient engagement piece 6 and the terminal locking projection 11.

Figure 5F:
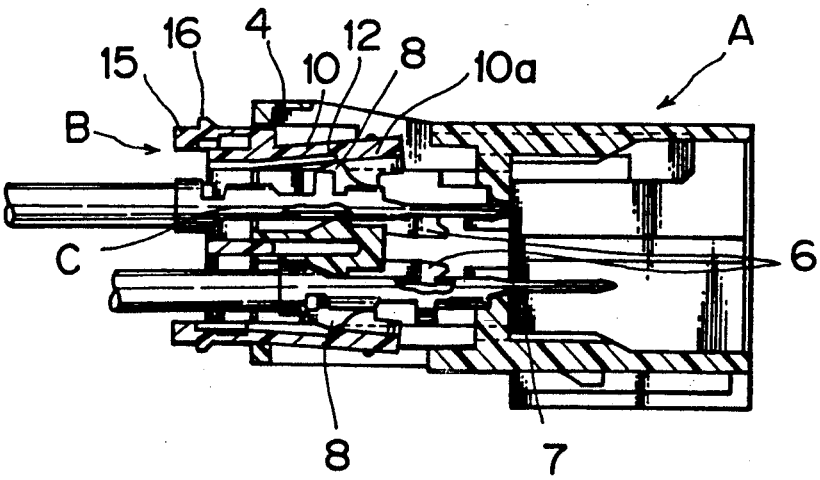
Figure 6:
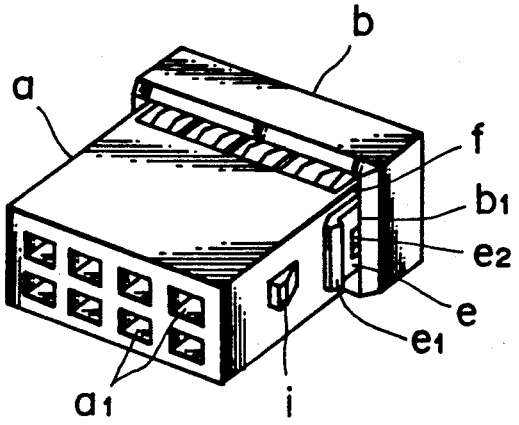
FIG. 6 PRIOR ART
FIG. 6 is a perspective view of a conventional connector housing with a terminal locking member.
Figure 7A:
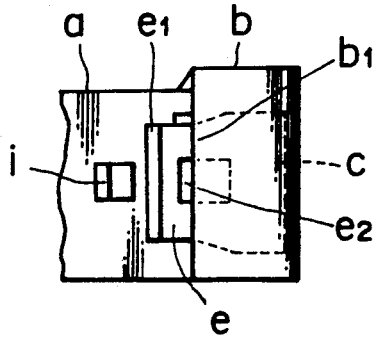
FIG. 7A PRIOR ART
FIGS. 7A and 7B are side views showing essential portions of FIG. 6.
Figure 7B:
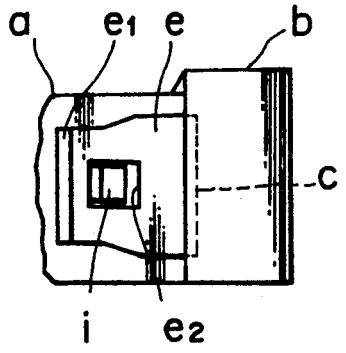
FIG. 7B PRIOR ART
Figure 8A:
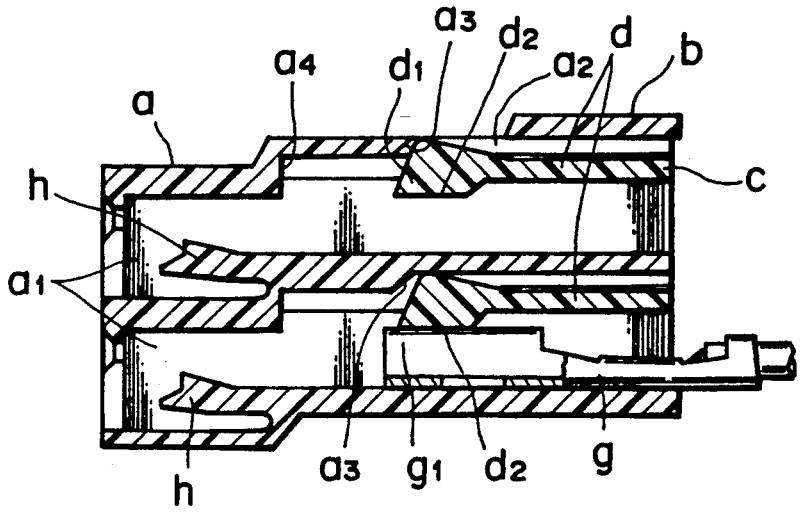
FIG. 8A PRIOR ART
FIGS. 8A and 8B are cross sections of FIGS. 7A and 7B.
Figure 8B:
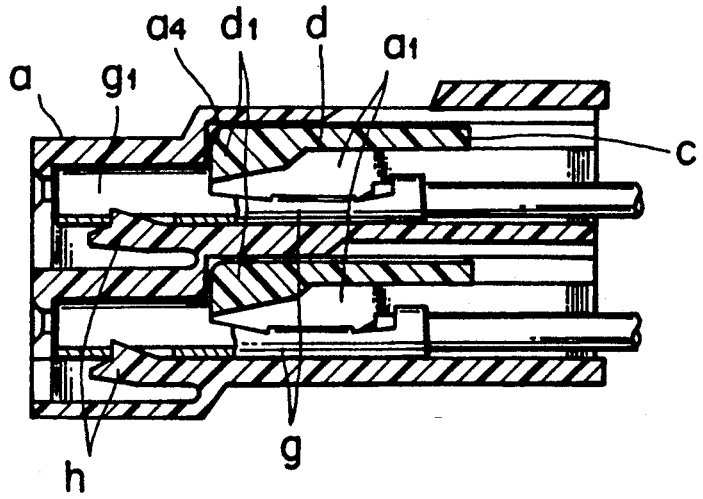
FIG. 8B PRIOR ART

When it becomes necessary to replace the terminal lug C as when it is broken, the full-engagement projection 16 of the engagement plate 15 is disengaged from the full-engagement ensuring portion 4 and then the terminal locking member B is pulled back until the engagement pieces 14 come into contact with the pull-out prevention projections 5. This causes the thick end portion 10a of the resilient support piece 10 to ride on the triangular engagement projection 8 displacing the terminal locking projection 11 outwardly out of the insertion path of the terminal lug C. In this condition, using a jig (not shown), the resilient engagement piece 6 is disengaged from the terminal lug C, which is then pulled out from the connector housing A (FIG. 5F).

The construction and advantages of the invention may be summarized as follows. The connector of this invention consists of a connector housing with a plurality of terminal accommodating chambers and a terminal locking member movably mounted to the rear portion of the connector housing in one of two engagement states—a preliminarily engaged state and a fully engaged state. The terminal locking member has resilient support pieces for the terminal lugs. When the terminal locking member is moved backwardly from the preliminarily engaged state, the resilient support pieces ride on the triangular engagement projections, forcing the terminal locking projections to move out of the insertion path of the terminal lugs. This allows the terminal lug in question to be pulled out without disengaging the terminal locking member from the connector housing.

What is claimed is:

1. A connector with a terminal locking member comprising:

a connector housing having a plurality of chambers accommodating terminal lugs therein;

a terminal locking member mounted at a rear portion of said connector housing movably in two steps, said two steps including a preliminarily engaged state and a fully engaged state;

resilient support pieces provided in said terminal locking member for fixing said terminal lugs in the terminal accommodating chambers; and engagement projections provided in said connector housing for holding said terminal locking member in the preliminarily engaged state;

whereby when said terminal locking member is moved backwardly from the preliminarily engaged state, said resilient support pieces ride on said engagement projections, and thereby cause said resilient support pieces to move out of the insertion paths of said terminal lugs.

2. A connector as claimed in claim 1, wherein said resilient support pieces have step portions adapted to engage said engagement projections.

3. A connector as claimed in claim 2, wherein said resilient support pieces have terminal locking projections adapted to lock said terminal lugs.

4. A connector as claimed in claim 3, wherein said terminal locking projections are located forwardly of said step portions.

5. A connector as claimed in claim 1, wherein said terminal locking member has an engagement piece and said connector housing has a pullout prevention projection adapted to engage said engagement piece of the terminal locking member when said terminal locking member is moved backwardly from the preliminarily engaged state so as to prevent said terminal locking member from being pulled out from said connector housing.

6. A connector as claimed in claims 1, wherein said engagement projections are in a triangular configuration having forwardly and rearwardly inclined surfaces, whereby said resilient support pieces may ride thereon.

* * * * *